US006963162B1

(12) United States Patent
Centurioni

(10) Patent No.: US 6,963,162 B1
(45) Date of Patent: Nov. 8, 2005

(54) GAS DISTRIBUTOR FOR AN ION SOURCE

(75) Inventor: Dominick Centurioni, Jeffersonville, PA (US)

(73) Assignee: Dontech Inc., Doylestown, PA (US)

( * ) Notice: Subject to any disclaimer, the term of this patent is extended or adjusted under 35 U.S.C. 154(b) by 47 days.

(21) Appl. No.: 10/459,883

(22) Filed: Jun. 12, 2003

(51) Int. Cl.[7] ..... H05H 1/00
(52) U.S. Cl. ..... 313/359.1; 313/231.01; 313/362.1; 315/111.01; 315/111.81
(58) Field of Search ..... 313/359.1, 616, 313/362.1, 231.01, 231.31, 231.41, 62, 230, 313/236.1; 315/111.81, 111.91, 111.01, 111.21, 315/279, 374; 156/345.34; 250/423 R; 118/723 R, 118/273; 219/121.5, 130, 121.57; 445/15, 445/16, 2, 61

(56) References Cited

U.S. PATENT DOCUMENTS 3,638,058 A * 1/1972 Fritzius ..... 313/359.1
4,862,032 A 8/1989 Kaufman et al. ..... 313/359.1
5,180,467 A * 1/1993 Cook et al. ..... 156/345.34
5,517,077 A * 5/1996 Bright et al. ..... 313/359.1
5,793,195 A * 8/1998 Kaufman et al. ..... 324/71.3
6,612,105 B1 * 9/2003 Voigt et al. ..... 60/202

* cited by examiner

*Primary Examiner*—Karabi Guharay
*Assistant Examiner*—Anthony Canning
(74) *Attorney, Agent, or Firm*—Howson and Howson

(57) ABSTRACT

A gas distributor for an ion source includes a plate having a recess and a series of apertures spaced radially outward from the recess. The apertures define paths for the flow of a gas through the plate, and the gas distributor further includes a sacrificial element that is separate from the plate and that is receivable and seats within the recess. The sacrificial element forms an area of the gas distributor that is subjected to erosive forces during normal operations of the ion source, and therefore, prevents erosion of the surface of the plate. The sacrificial element is removable from the plate and replaceable with another sacrificial element during a procedure which neither requires the plate to be removed from the ion source nor the ion source to be disassembled.

18 Claims, 10 Drawing Sheets

GAS DISTRIBUTOR FOR AN ION SOURCE

FIELD OF THE INVENTION

The present invention relates to ion sources used, for instance, in apparatus and methods that deposit thin films on articles in vacuum chambers, and more particularly, the present invention relates to an ion source having an improved gas distributor plate.

BACKGROUND OF THE INVENTION

Ion sources, such as so-called gridless ion sources of the end-Hall-type, are used to produce ion beams for use, for instance, with sputtering targets or the like to deposit thin films on articles located within high vacuum coating chambers. An example of an end-Hall ion source is disclosed by U.S. Pat. No. 4,862,032 issued to Kaufman et al. Such an ion source typically includes an anode and cathode between which a potential is impressed to produce a flow of electrons. A magnetic field is established between the anode and cathode to define the path of the electrons, and a distributor plate is used to direct a flow of working gas to the anode and cathode so that the electrons bombard and collide with the neutral atoms or molecules of the working gas to create a conductive gas or plasma.

As disclosed by the Kaufman '032 patent on column 3, lines 64–67, column 8, lines 54–55, and column 9, lines 34–54, such an ion source requires routine maintenance including cleaning and replacement of eroded parts. For example, the gas distributor plate erodes during normal operation since it is repeatedly struck by energetic ions. Most of the erosion of the gas distributor plate occurs at the center of the plate that faces the central opening of the annular anode. Replacement of the gas distributor plate prevents the erosion from creating an undesired hole in the center of the gas distributor plate and reduces contamination of the target. From a practical standpoint, it has been determined that a gas distributor should be replaced when its thickness at an eroded central location is reduced to approximately half of its original thickness. Thus, maintenance of such an ion source includes periodic dimensional measurement of the erosion depth of the gas distributor.

Measurement of the erosion depth of a gas distributor plate, which is typically located within the housing of an ion source assembly, is difficult to accurately perform when the ion source is assembled. Thus, this measurement can only accurately be determined when the ion source is disassembled, which is typically only performed when the ion source is due for a thorough cleaning. Of course, disassembly of the ion source is also required to replace the gas distributor.

FIGS. 1–7 provide an example of the steps required to disassemble a gridless ion source. An assembled gridless ion source 10 is shown in FIG. 1. Typically, the ion source 10 is mounted to a support bracket (not shown) via a socket 12 shown in FIG. 2. Thus, the ion source 10 must be disconnected from the socket 12, and then the cathode 14 and cathode supports 16 are removed as shown in FIG. 3. The front support plate 18 is removed followed by the outer shell 20 as illustrated in FIG. 4. The front anode support 22 is then removed followed by the anode 24 and rear anode support 26 as illustrated in FIGS. 5 and 6. Thereafter, the gas distributor 28 is removed as shown in FIG. 7 so that the extent of erosion at its center can be measured. If the amount of erosion is within acceptable limits the gas distributor 28 is re-installed. If not, a new gas distributor is installed. The time required to perform the above tasks typically requires about one hour of labor and is required to be performed more frequently than scheduled thorough cleanings of the ion source.

While the ion source, gas distributor, and maintenance procedures disclosed above may be satisfactorily for their intended purposes, there is a need for a gas distributor, ion source, and maintenance procedure therefor that permit ready and precise inspection of an eroded surface area of a gas distributor and that simplifies the steps required to place an ion source into an in-service condition with a gas distributor having desired surface qualities. To this end, the required labor and downtime of the ion source should be reduced, the material costs related to providing a distributor plate with a desired surface should be reduced, and accurate erosion measurements should be capable of being readily taken at frequent intervals within a minimum of time and requiring only a minimum of skills.

OBJECTS OF THE INVENTION

With the foregoing in mind, a primary object of the present invention is to provide a novel gas distributor for an ion source.

Another object of the present invention is to provide improved and simplified maintenance procedures for measuring the eroded area of a gas distributor and for placing the ion source in-service with a gas distributor having desired surface characteristics.

SUMMARY OF THE INVENTION

More specifically, the present invention provides a gas distributor for an ion source. The gas distributor is a plate having a recessed central portion and a series of apertures spaced radially outward from the recessed central portion. The apertures define paths for the flow of a gas through the plate within the ion source. The gas distributor also accommodates a sacrificial element that is separate from the plate and that is receivable and seats within the recessed central portion of the plate. The sacrificial element positioned in the recessed central portion on top of the gas distributor plate is subjected to erosive forces during normal operations of the ion source, and therefore, prevents erosion of the surface of the gas distributor plate. The sacrificial element is removable from the gas distributor plate and replaceable with another sacrificial element during a procedure which neither requires the gas distributor plate to be removed from the ion source nor the ion source to be disassembled.

According to another aspect of the present invention, an ion source having an anode, cathode and gas distributor plate is provided. The gas distributor plate directs a flow of gas in a discharge area defined by the anode and cathode, and a separate sacrificial element is receivable within a recess formed on the gas distributor plate. The sacrificial element prevents erosion of the gas distributor plate during normal operation of the ion source and can be replaced without disassembly of the ion source.

According to yet another aspect of the present invention, a method is provided for inspecting and restoring a gas distributor plate that is mounted within an ion source and that is subject to erosive forces during normal operation of the ion source. The method includes the step of removing from the ion source a separate first sacrificial element located on the gas distributor plate. The removal of the sacrificial element is accomplished while the gas distributor plate is mounted within the ion source and while the ion source is in an assembled condition. Preferably, the method also includes re-positioning the first sacrificial element or positioning a separate second sacrificial element on the gas distributor plate while the gas distributor plate is mounted within the ion source and while the ion source is in an assembled condition. Thus, the depth of erosion can be inspected and a desired surface of the sacrificial element can be restored within a minimum of time.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 11:
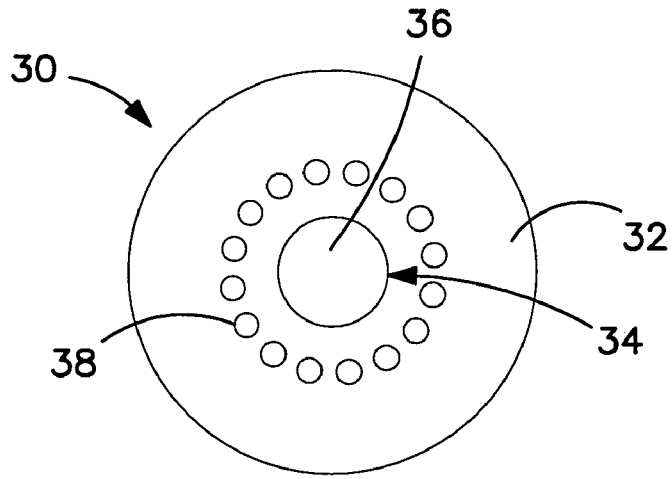
FIG. 11 is a plan view of a gas distributor according to the present invention.
Figure 12:
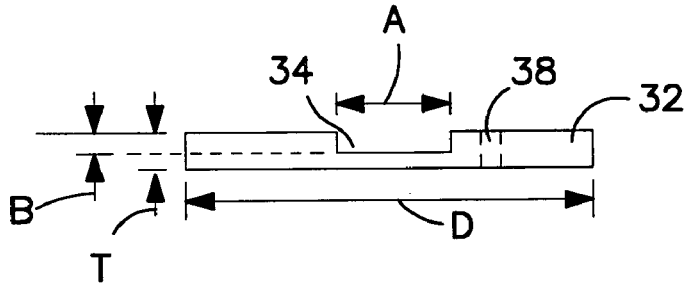
FIG. 12 is a side elevational view of the gas distributor plate of FIG. 11.
Figure 13:
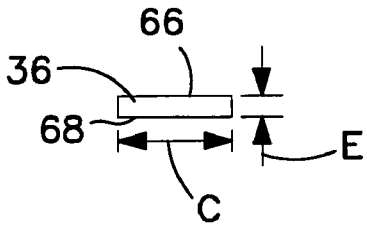
FIG. 13 is a side elevational view of the sacrificial element according to the present invention.

The present invention relates to a gas distributor 30 as best illustrated in FIGS. 11–13. As will be discussed in greater detail, the gas distributor 30 includes a plate 32 having a recessed central portion 34 for receiving a separate sacrificial element 36. Thus, when the gas distributor 30 is installed within an ion source, the sacrificial element 36 can be removed and replaced without requiring disassembly of the ion source. Such a procedure can be accomplished in approximately less than two minutes.

Figure 1:
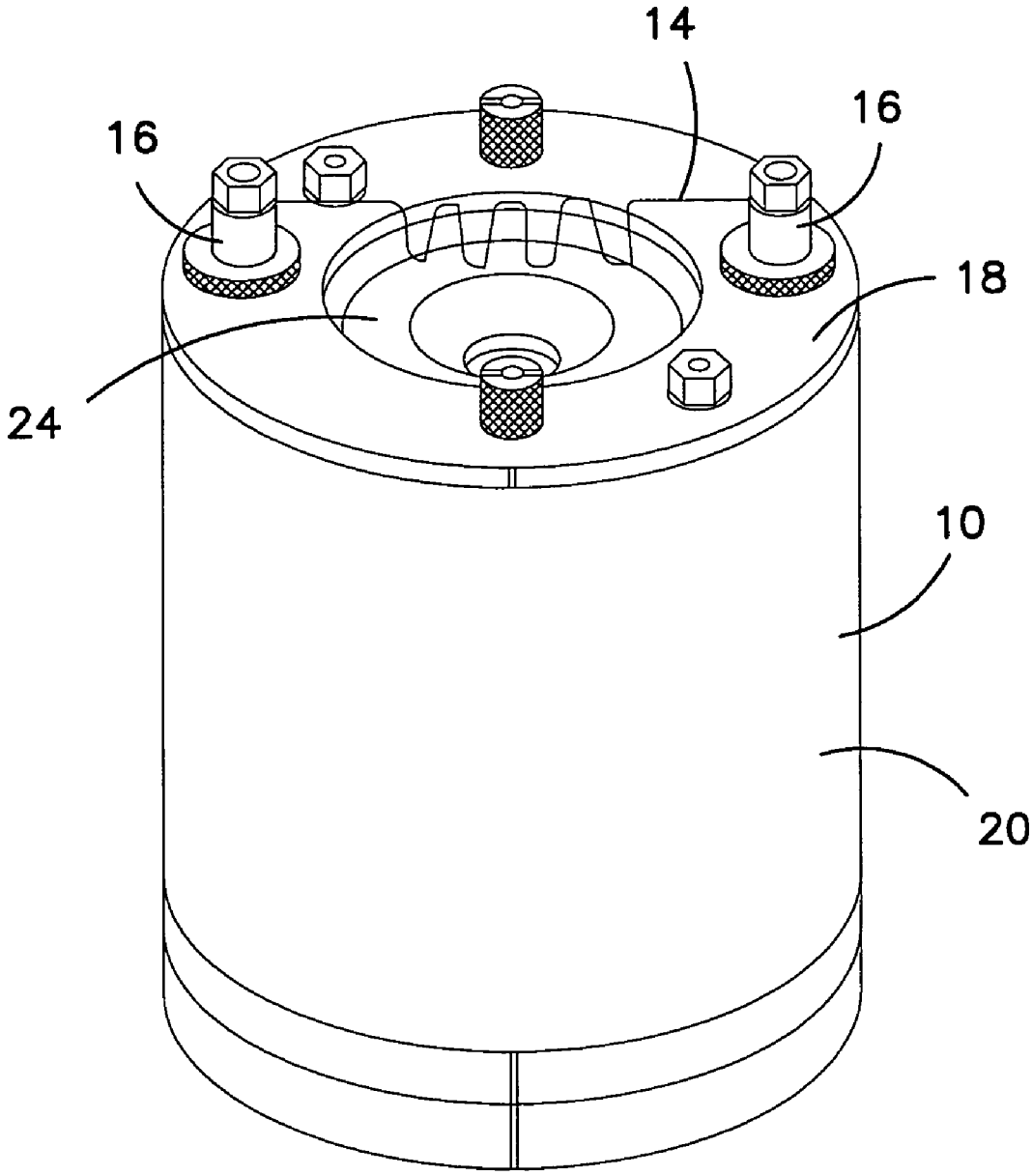
FIG. 1 Prior Art
FIGS. 1–7 are perspective views of an assembled and partially disassembled gridless ion source according to the prior art.
Figure 2:
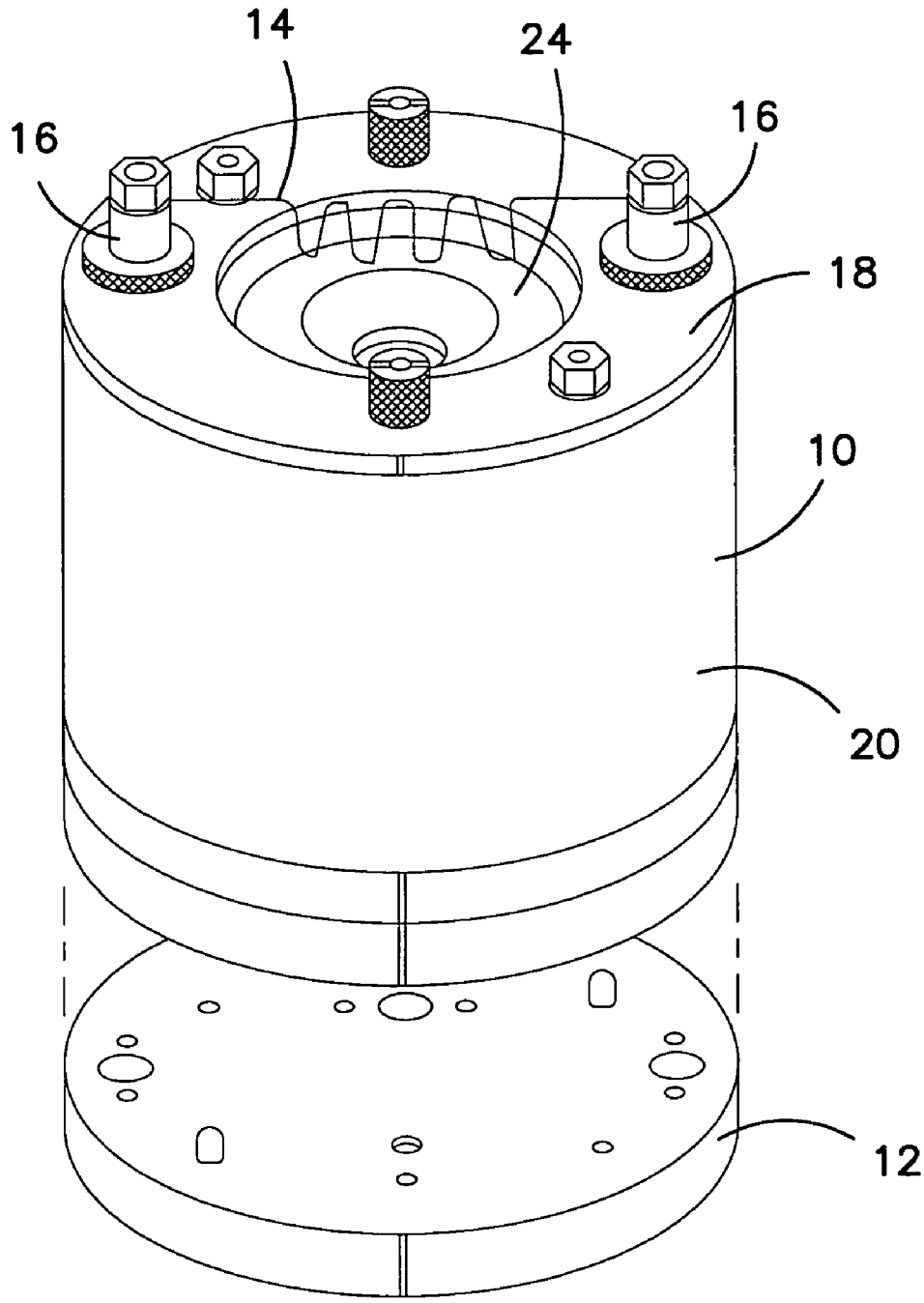
FIG. 2 Prior Art
Figure 3:
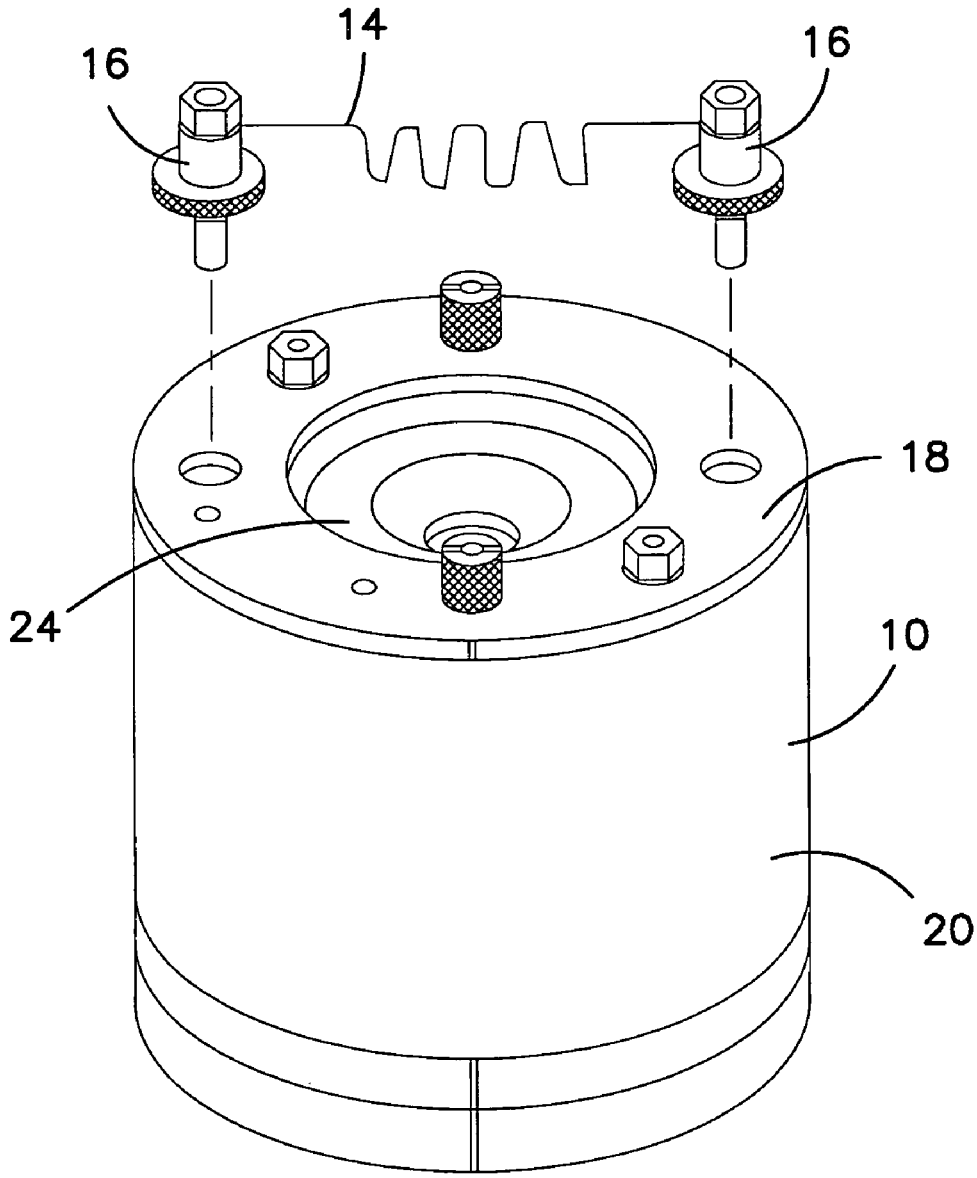
FIG. 3 Prior Art
Figure 4:
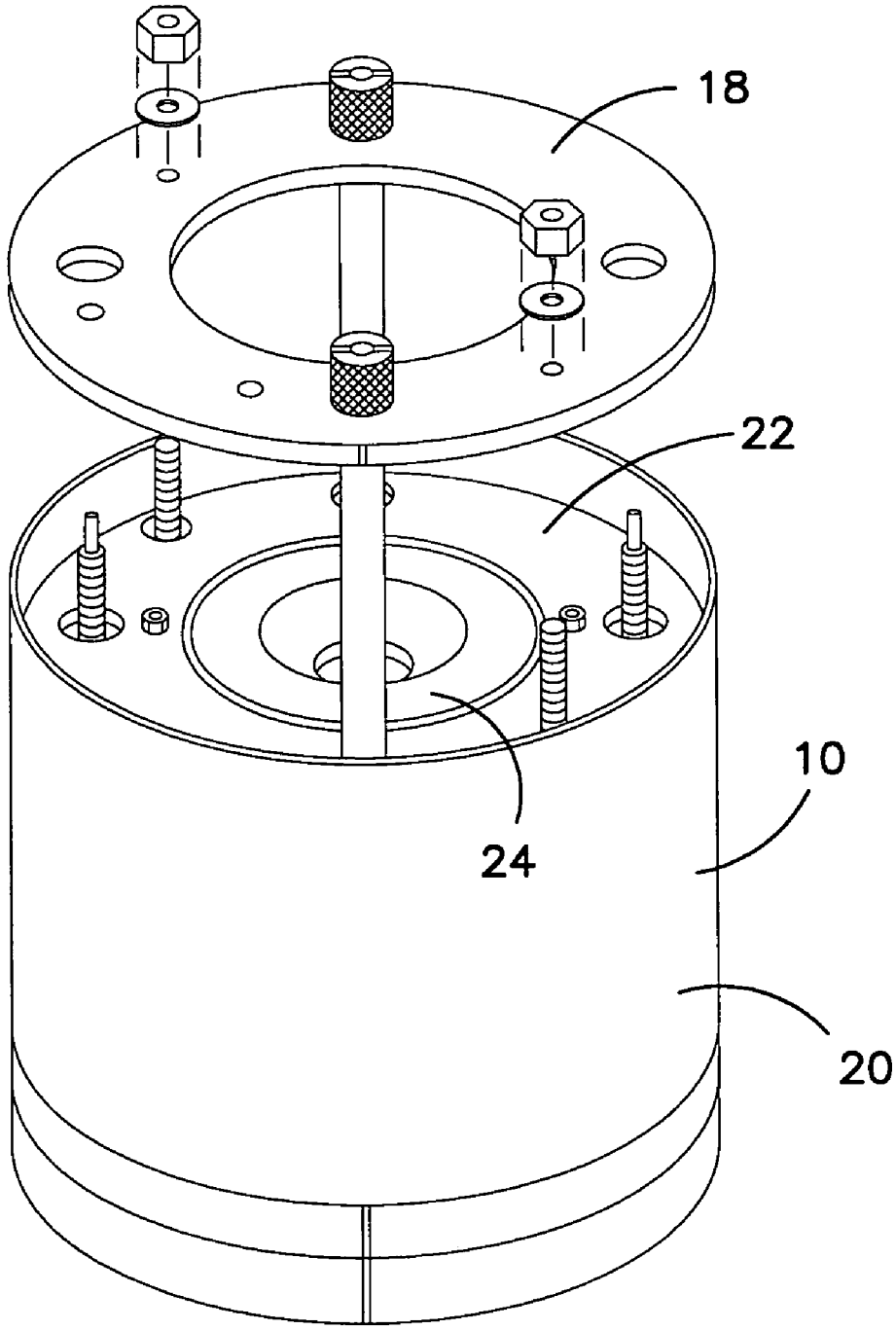
FIG. 4 Prior Art
Figure 5:
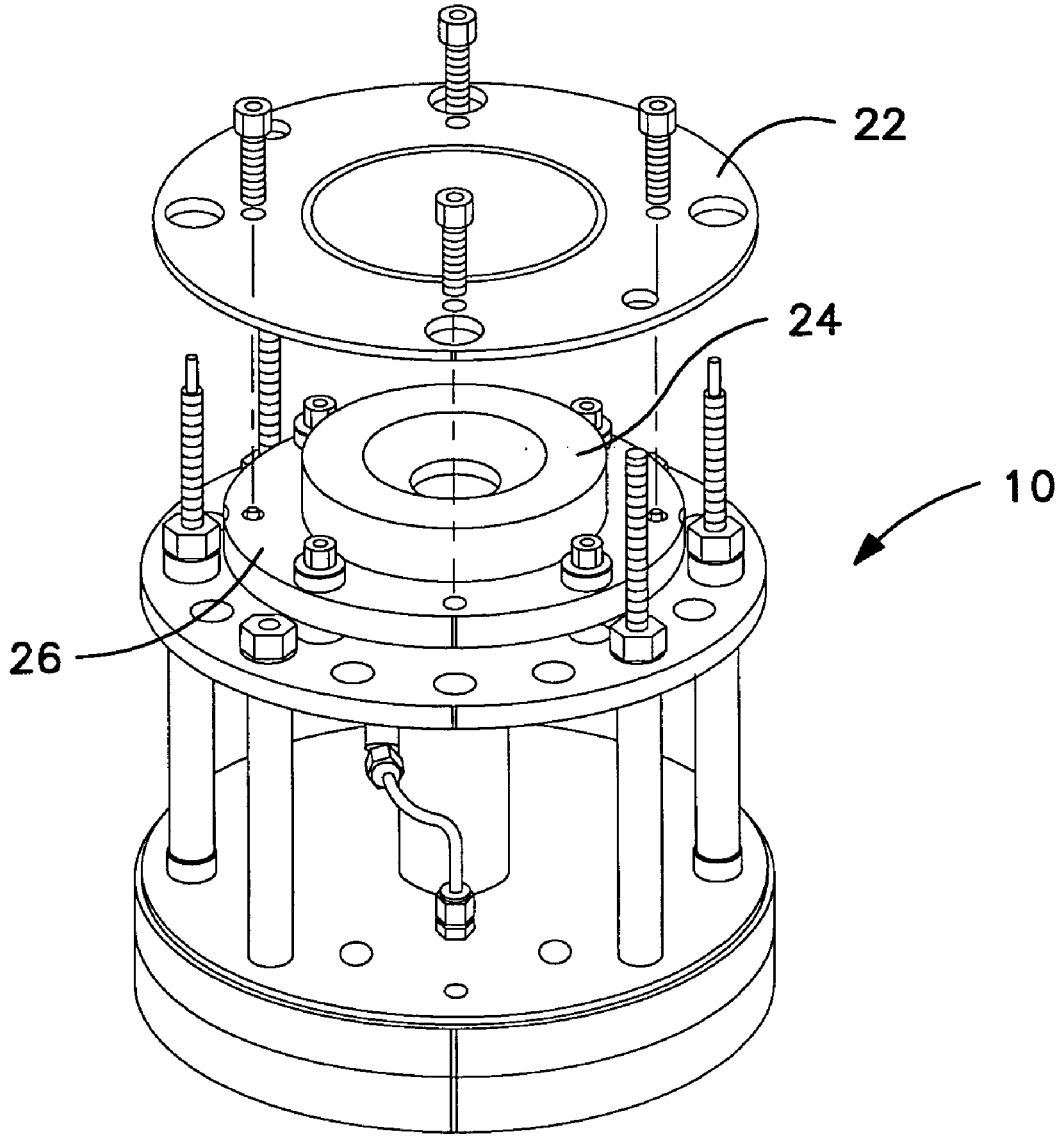
FIG. 5 Prior Art
Figure 6:
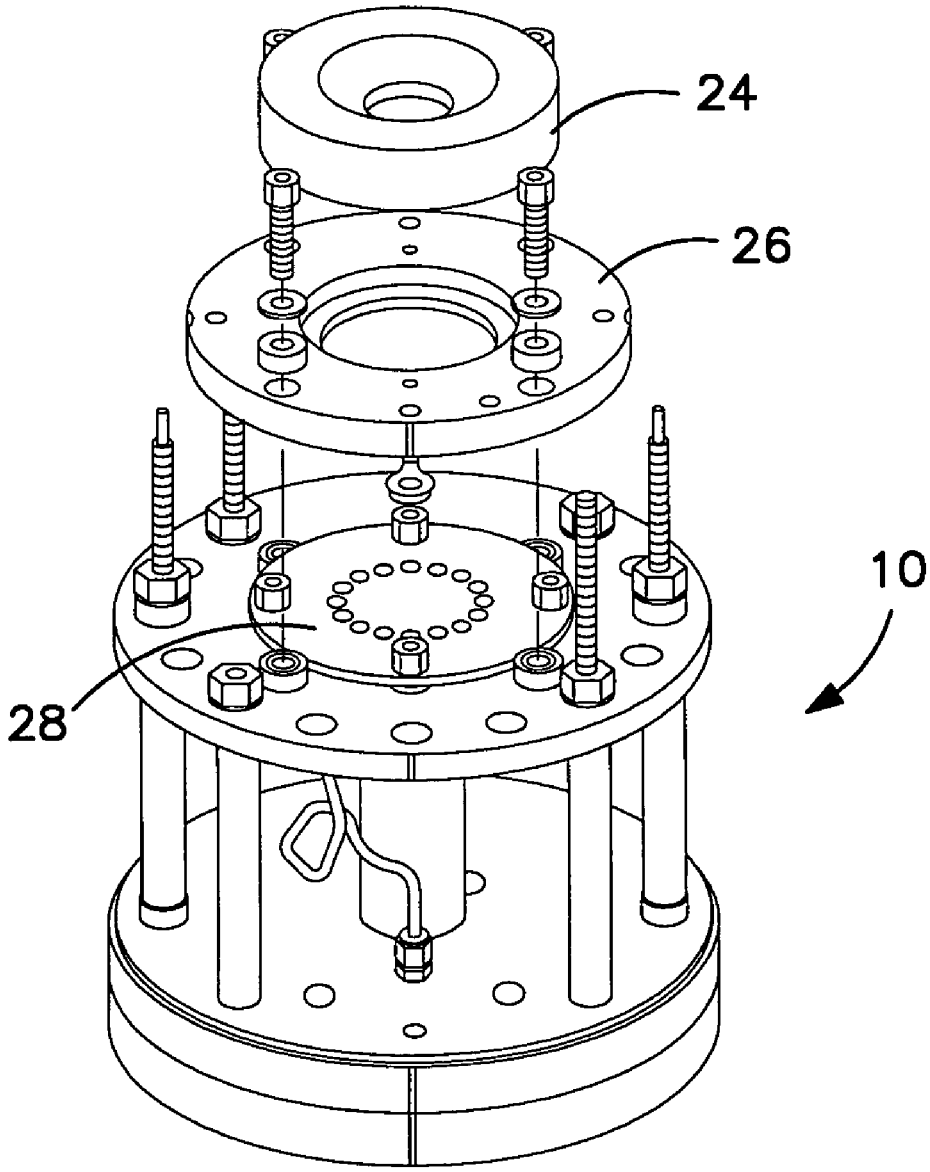
FIG. 6 Prior Art
Figure 7:
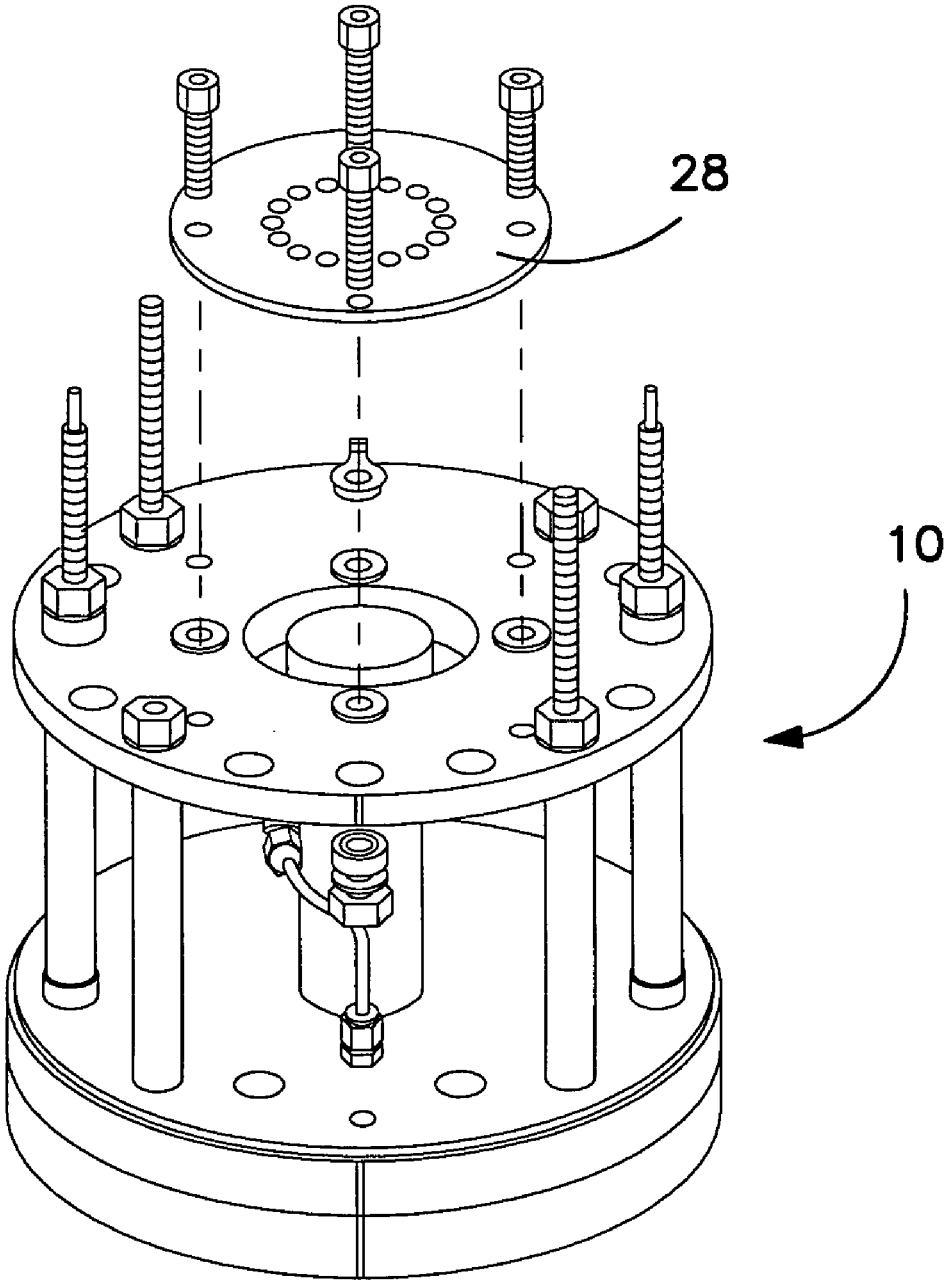
FIG. 7 Prior Art
Figure 8:
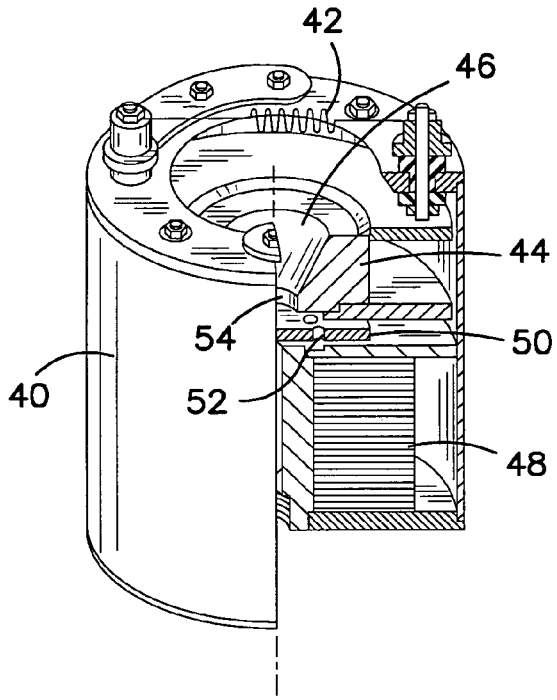
FIG. 8 Prior Art
FIG. 8 is an isometric view, partially broken away in cross-section, illustrating an end-Hall ion source according to the prior art.
Figure 9:
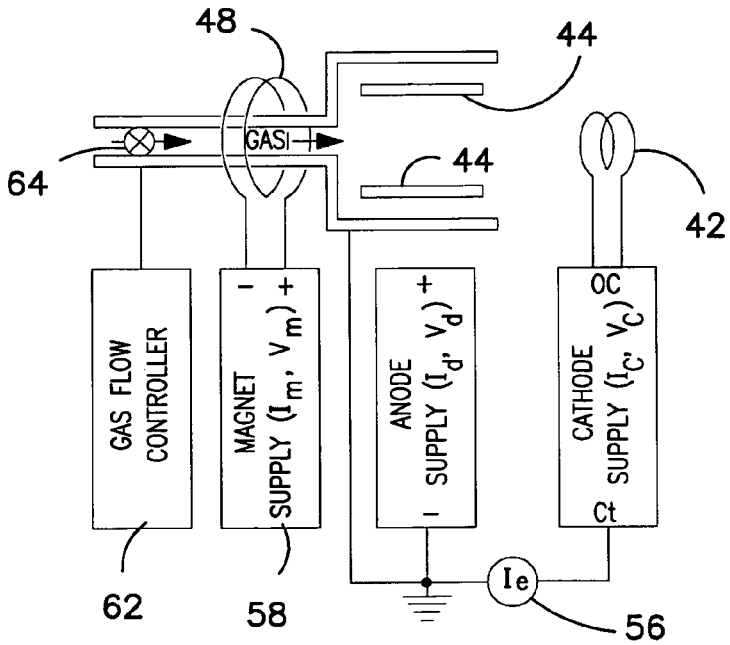
FIG. 9 Prior Art
FIG. 9 is a schematic diagram of energization and control circuitry of the ion source of FIG. 8.

Turning to the structure of a typical ion source, such as a gridless end-Hall ion source, the disclosure of U.S. Pat. No. 4,862,032 is herein incorporated by reference. To this end, the ion source 40 illustrated in FIGS. 8 and 9 include a cathode 42 spaced from an annular anode 44 having a frustoconical inner peripheral wall 46. An electromagnet 48 is located on a side of the anode 44 opposite the cathode 42 and creates a magnetic field between the cathode 42 and anode 44 that decreases in strength from the anode 44 to the cathode 42. A gas distributor 50 is located adjacent the anode 44 between the anode 44 and electromagnet 48. The gas distributor 50 has a circular pattern of apertures 52 that are located beneath the anode 44 and that are spaced outwardly relative to a central opening 54 of the annular anode 44 that faces the gas distributor 50.

Figure 10:
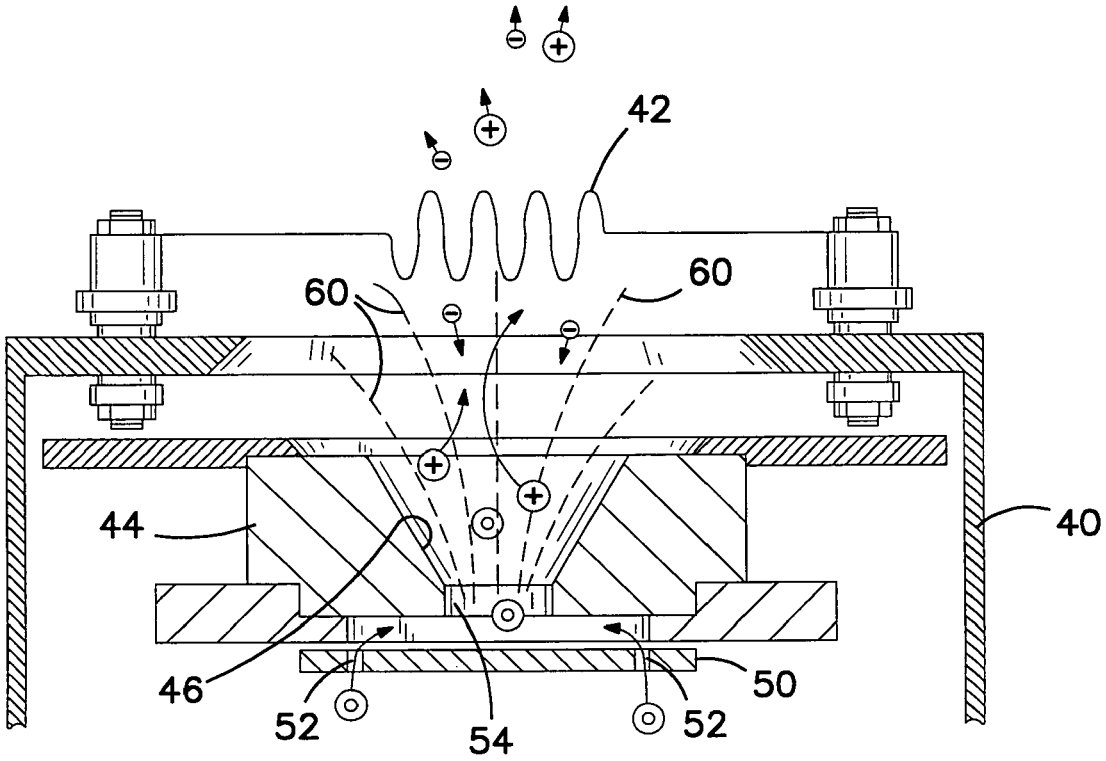
FIG. 10 Prior Art
FIG. 10 is a cross-sectional view of an upper portion of the ion source of FIG. 8.

A potential is applied between the anode 44 and cathode 42, for instance by an alternating current supply 56, thereby producing a flow of electrons (depicted in FIG. 10 by "–") in a direction from the cathode 42 toward the anode 44. The electromagnet 48 is energized, for instance by a direct current source 58, to create a magnetic field as shown by lines 60 in FIG. 10. A gas flow controller 62 operates a valve 64 to control the flow of a working gas to the gas distributor 50. The working gas has neutral atoms or molecules (depicted in FIG. 10 as "0") and is fed through the apertures 52 in the gas distributor 50 so that the gas is uniformly fed into a discharge region within the annular anode 44. The electrons strike the neutral atoms or molecules thereby producing ions (depicted in FIG. 10 as "+"). The mixture of electrons and ions forms a desired conductive gas or plasma.

According to the present invention, the gas distributor 50 described in the above example is replaced with the gas distributor 30 according to the present invention. See FIGS. 11–13. The gas distributor plate 32 has a series of apertures 38 similar to that of distributor 50. However, unlike distributor 50, the gas distributor plate 32 according to the present invention has a recessed central portion 34 that receives and holds a separately formed sacrificial element 36.

As discussed previously, the surface portion of a gas distributor that faces the anode is subject to erosive forces during normal operation of the ion source. Typically, this surface corresponds to a central portion of the gas distributor that faces the central opening 54 of an annular anode 44. Thus, the sacrificial element 36 of the present invention forms the part of the distributor 30 that will be eroded during normal operation of the ion source. The sacrificial element 36 is removable from the distributor plate 32 without requiring the distributor plate 32 to be removed from the ion source. Thus, complete or partial disassembly of the ion source is not required to remove and/or replace the sacrificial element 36.

In the illustrated embodiment, the gas distributor plate 32 is a disc having a diameter "D", for example, of about 3 inches and a thickness "T", for example, of about 0.10 to about 0.12 inch. Preferably, about sixteen apertures 38 are uniformly spaced in a circular array concentric to a recessed central portion 34 formed on a top surface of the gas distributor plate 32. The recess 34 can be formed, for instance, by machining a flat-bottom, circular hole into the center of the top surface of the gas distributor plate 32. The recess 34 can have, for example, a diameter "A" of about 0.7 inch and a depth "B" of about 0.06 inch. Thus, the depth "B" of the recess 34 is preferably about equal to the thickness "E" of the sacrificial element 36 and is preferably about half of the thickness "T" of the surrounding sections of the plate 32.

Preferably, the sacrificial element 36 has dimensions permitting it to be slip fit into the recess 34 of the plate 32. The sacrificial element 36 should be held firmly in place within the recess 34 yet be capable of being readily removed therefrom. For example, the illustrated embodiment of the sacrificial element 36 is disc shaped corresponding to the shape of the recess 34 and can have, for instance, a diameter "C" of slightly less than 0.7 inch and a thickness "E" of about 0.06 inch. Of course, all of the above referenced dimensions, shapes, patterns and the like of the plate 32 and sacrificial element 36 can be modified as desired.

The gas distributor plate 32 can be made of graphite, non-magnetic stainless steel, molybdenum, tantalum, or any relatively strong non-magnetic material. The sacrificial element 36 can be made of graphite, non-magnetic stainless steel, molybdenum, tantalum, or any other material that is compatible with a user application. The plate 32 and sacrificial element 36 can be made of the same or different material. Thus, for example, a molybdenum element 36 can be used with a non-magnetic stainless steel distributor plate 32. This provides an advantage in that the user can select the best material for the sacrificial element 36 for his/her particular needs without having to disassemble an ion source and replace the entire gas distributor.

In addition, preferably the sacrificial element 36 has identical opposite faces, 66 and 68, as manufactured. Thus, after one of the faces has been eroded beyond a predetermined limit, the sacrificial element 36 can be re-positioned within the recess 34 in an inverted position to thereby permit the opposite face to be subject to the erosive forces.

The maintenance procedure for an ion source having a gas distributor according to the present invention is greatly simplified. To this end, a tool (not shown), such as tweezers, an elongate tool with an exposed adhesive tip, or the like, is simply inserted into an assembled ion source and is used to grasp the sacrificial element 36 seated on the plate 32. The element 36 is quickly withdrawn from the ion source and a new element is slip fit with the tweezers or like tool into the recess 34 of the distributor plate 32 mounted within the ion source. Alternatively, the original sacrificial element 36 can be re-positioned within the recess 34 in an inverted or non-inverted position. Such a procedure should take less than two minutes of labor and should save about an hour of downtime relative to replacing/inspecting prior art gas distributor plates.

Preferably, the ion source has an annular anode with a central opening that faces the gas distributor 30 of the present invention. The recess 34 of the gas distributor plate 32 is aligned with and faces the central opening of the annular anode. This location corresponds to the section of the plate 32 to which erosive forces will be directed. Thus, the sacrificial element 36 is located in the recess 34 and protects the plate 32 from undesired erosion. The central opening of the annular anode provides accessibility to the sacrificial element 36 and recess 34. Thus, the sacrificial element 36 is withdrawn from the recess 34 and ion source through the annular anode and is replaced and/or repositioned on the gas distributor plate 32 via the central opening of the annular anode.

During normal operations of the ion source, the sacrificial element 36 will be eroded. The above described maintenance procedure can be performed at frequent intervals without significant, or any, downtime of the ion source. Erosion of the removed element 36 can be accurately measured after the sacrificial element 36 is removed form the ion source to determine whether or not it can be further utilized. In addition, each element 36 has two sides, and when one side is eroded beyond a pre-determined limit, it can be flipped over and re-positioned on the distributor plate 32 so that its opposite side can be subject to erosion. Thus, both sides of the element 36 can be eroded thereby providing further material cost savings.

While a preferred gas distributor, ion source and maintenance procedure therefor have been described in detail, various modifications, alterations, and changes may be made without departing from the spirit and scope of the distributor and method according to the present invention as defined in the appended claims.

What is claimed is:

1. A gas distributor for an ion source having an annular anode with a central opening, comprising:

a gas distributor plate having a recessed central portion and a series of apertures spaced radially outward from said recessed central portion, said apertures defining paths for the flow of gas through the gas distributor plate; and a sacrificial element receivable within said recessed central portion for preventing erosion of said gas distributor plate, said sacrificial element being removable from said gas distributor plate through the central opening of the anode so that said sacrificial element is replaceable without requiring the ion source to be disassembled and without requiring the gas distributor plate to be disassembled from the ion source;

said gas distributor plate and said sacrificial element being made of different materials.

2. A gas distributor plate according to claim 1, wherein said sacrificial element has dimensions permitting it to be slip fit into said recessed central portion.

3. A gas distributor plate according to claim 2, wherein said sacrificial element has a first face and an opposite second face, and wherein said sacrificial element is receivable within said recessed central portion in a first position in which said first face faces outwardly of said plate and in a second position in which said second face faces outwardly of said plate.

4. A gas distributor plate according to claim 3, wherein said sacrificial element is disc-shaped having substantially identical first and second faces, as manufactured.

5. A gas distributor plate according to claim 3, wherein said series of apertures are positioned in a circular array concentric with said recessed central portion.

6. A gas distributor plate according to claim 5, wherein said depth of said recessed central portion is approximately equal to half the thickness of surrounding sections of said gas distributor plate.

7. A gas distributor plate for an ion source having an annular anode with a central opening, comprising:

a gas distributor plate having a recessed central portion and a series of apertures spaced radially outward from said recessed central portion, said apertures defining paths for the flow of gas through the gas distributor plate; and a sacrificial element receivable within said recessed central portion for preventing erosion of said gas distributor plate, said sacrificial element being removable from said gas distributor plate through the central opening of the anode so that said sacrificial element is replaceable without requiring the ion source to be disassembled and without requiring the gas distributor plate to be disassembled from the ion source;

said gas distributor plate being made of a material selected from the group consisting of graphite, non-magnetic stainless steel, molybdenum and tantalum; and said sacrificial element being made of a material selected from the group consisting of graphite, non-magnetic stainless steel, molybdenum and tantalum.

8. An ion source having an anode, cathode and gas distributor plate, said anode being annular and having a central opening and said gas distributor plate facing said anode and having a series of apertures for directing a flow of gas through said anode in a discharge area defined by said anode and cathode, wherein the improvement comprising:

a separate solid sacrificial element receivable within a recess formed in said gas distributor plate for preventing erosion of said gas distributor plate during normal operation of said ion source;

said recess being formed on a top surface of said gas distributor plate and being aligned with said central opening of said anode, said series of apertures of said gas distributor plate being spaced radially outward of said recess; and said sacrificial element being accessible and removable from said gas distributor plate through said central opening of said annular anode when said ion source is in an assembled condition.

9. An ion source according to claim 8, wherein said sacrificial element has dimensions permitting it to be slip fit into said recess.

10. An ion source according to claim 9, wherein said sacrificial element is disc-shaped and has opposite faces, and wherein said sacrificial element is receivable within said recess in a first position in which one of said faces is directed toward said anode and in a second position in which said opposite face is directed toward said anode.

11. An ion source according to claim 9, wherein said depth of said recess is approximately equal to half the thickness of surrounding sections of said gas distributor plate.

12. An ion source according to claim 9, wherein said gas distributor plate is made of a material selected from a group consisting of graphite, non-magnetic stainless steel, molybdenum and tantalum; and wherein said sacrificial element is made of a material selected from a group consisting of graphite, non-magnetic stainless steel, molybdenum and tantalum.

13. An ion source according to claim 9, wherein said gas distributor plate and said sacrificial element are made of different materials.

14. A method of inspecting and restoring a gas distributor plate that is mounted within an ion source and that is subject to erosion during normal operation of the ion source, comprising the steps of:

removing a separate first sacrificial element that is located on the gas distributor plate from the ion source, said removing step being accomplished while the gas distributor plate is mounted within the ion source and while the ion source is in an assembled condition; and positioning a separate second sacrificial element on the gas distributor plate while the gas distributor plate is mounted within the ion source and while the ion source is in said assembled condition.

15. A method according to claim 14, wherein the gas distributor plate has a recess in which said first and second sacrificial elements are held, and wherein said removing step includes removing said first sacrificial element from said recess and said positioning step includes positioning said second sacrificial element in said recess.

16. A method according to claim 15, wherein the ion source has an annular anode with a central opening and the gas distributor plate has a series of apertures for uniformly directing a flow of gas through said annular anode, wherein said recess of the gas distributor plate is aligned with and faces said central opening of said annular anode, and wherein said first sacrificial element is withdrawn through said central opening of said annular anode during said removing step and said second sacrificial element is inserted through said central opening of said annular anode during said positioning step.

17. A method according to claim 14, further comprising the step of measuring a depth of erosion of said first sacrificial element after said removing step.

18. A method of restoring a gas distributor plate that is mounted within an ion source, comprising the steps of:

removing a sacrificial element that is located on the gas distributor plate from the ion source, said removing step being accomplished while the gas distributor plate is mounted within the ion source and while the ion source is in an assembled condition; and re-positioning said sacrificial element on the gas distributor plate while the gas distributor plate is mounted within the ion source and while the ion source is in said assembled condition, said sacrificial element being placed on the gas distributor plate in an inverted position during said re-positioning step.

* * * * *